United States Patent [19]

Sakamoto

[11] Patent Number: 4,999,267

[45] Date of Patent: Mar. 12, 1991

[54] PHOTOSENSITIVE MEMBER HAVING PHTHALOCYANINE COMPOUND AND ADDITIVE

[75] Inventor: Mitsutoshi Sakamoto, Osaka, Japan

[73] Assignees: Minolta Camera Kabushiki Kaisha, Osaka; Toyo Ink Mfg. Co., Ltd., Tokyo, both of Japan

[21] Appl. No.: 417,028

[22] Filed: Oct. 4, 1989

[30] Foreign Application Priority Data

Oct. 5, 1988 [JP] Japan ..... 63-252621
Oct. 5, 1988 [JP] Japan ..... 63-252622
Oct. 5, 1988 [JP] Japan ..... 63-252623

[51] Int. Cl.[5] ..... G03G 5/047; G03G 5/09

[52] U.S. Cl. ..... 430/58; 430/59; 430/83

[58] Field of Search ..... 430/58, 59, 83

[56] References Cited

U.S. PATENT DOCUMENTS 4,591,542 5/1986 Fujimaki et al. ..... 430/59
4,755,443 7/1988 Suzuki et al. ..... 430/83 X

FOREIGN PATENT DOCUMENTS 58-123542 7/1983 Japan ..... 430/59
61-35452 2/1986 Japan .
61-77054 4/1986 Japan .
63-206757 8/1988 Japan ..... 430/59

*Primary Examiner*—Roland Martin
*Attorney, Agent, or Firm*—Burns, Doane, Swecker & Mathis

[57] ABSTRACT

This invention relates to a photosensitive member having a laminated photosensitive layer constituted by a charge generating layer and a charge transporting layer on an electrically conductive substrate, wherein the charge generating layer comprises a phthalocyanine compound as a charge generating material and an additive selected from the group consisting of indoles having a primary amino group, indazoles having a primary amino group, planar monocyclic compounds of five-membered ring or more having a primary amino group, anthrones represented by the general formula [I] below and acridones represented by the general formula [II] below;

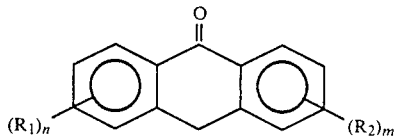

[I]

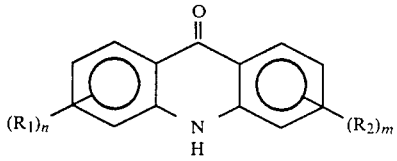

[II]

wherein n and m are an integer of 0–3 respectively; $R_1$ and $R_2$ are independently an alkyl group, an alkoxy group, an amino group, a hydroxy group, a halogen atom or a nitro group; when n is 2 or more, each $R_1$ may be same or different; when m is 2 or more, each $R_2$ may be same or different.

10 Claims, No Drawings

PHOTOSENSITIVE MEMBER HAVING PHTHALOCYANINE COMPOUND AND ADDITIVE

BACKGROUND OF THE INVENTION

This invention relates to a photosensitive member for electrophotography, in particular, a photosensitive member having a photosensitive layer containing a phthalocyanine compound.

Known photosensitive materials for forming a photosensitive member include inorganic photoconductive materials such as selenium, cadmium sulfide or zinc oxide.

These photosensitive materials have many advantages such as low loss of charges in the dark, an electrical charge which can be rapidly dissipated with irradiation of light and the like. However, they have disadvantages. For example, a photosensitive member based on selenium is difficult to produce, has high production costs and is difficult to handle due to inadequate resistivity to heat or mechanical impact. A photosensitive member based on zinc oxide, or cadmium sulfide has defects such as its unstable sensitivity in a highly humid environment, loss of stability with time because of the deterioration of dyestuffs added as a sensitizer by corona charge and fading with exposure.

Many kinds of organic photoconductive materials such as polyvinylcarbazole and the like have been proposed. These organic photoconducitive materials have superior film forming properties, are light in weight, etc., but inferior in sensitivity, durability and environmental stability compared to the aforementioned inorganic photoconductive materials.

Various studies and developments have been in progress to overcome the above noted defects and problems. A photosensitive member containing a phthalocyanine compound as a photoconductive material has been proposed in, for example, Japanese Patent Laid-Open Nos. 38543/1975, 95852/1986, 64040/1978, 83744/1988 and the like, because a phthalocyanine compound has been found to have excellent photoconductivity in the range from visible light region to near infrared light region.

Further, such a phthalocyanine-containing photosensitive member has been studied for its application to an electrophotographic printer with a semiconductor laser or a light emitting diode as a light sourse.

With respect to a photosensitive member, a mono-layer type and a laminated type are known. A photosensitive member of a mono-layer type is formed by applying a dispersion solution of a phthalocyanine compound, if necessary, a charge transporting material in binder resin onto an electrically conductive substrate to be 5–20 μm in thickness after dried. In order to form a photosensitive member of a laminated type, a phthalocyanine is deposited or a phthalocyanine is dispersed in a binder resin, to form a charge generating layer of 0.01–1 μm in thickness on an electrically conductive substrate. Then, a charge transporting layer of 10–30 μm in thickness is formed on the charge generating layer.

In the case of a function-divided photosensitive member of a laminated type containing a phthalocyanine, a charge generating function and a charge transporting function are divided by a different material. A charge generating material and a charge transporting material can be selected from various kinds of materials to improve sensitivity, charging properties, surface properties and the like required for a photosensitive member. Therefore, such a function-divided photosensitive member of a laminated type is utilized generally.

With respect to a phthalocyanine compound, the one of unstable crystal type is usually used because it effects higher sensitivity than that of stable crystal type.

But, a phthalocyanine compound of unstable crystal type has a lower electrical resistance than stable crystal type. Therefore, a photosensitive member containing a phthalocyanine compound of unstable crystal type has such problems that chargeability is poor and that a surface potential decreases when repeatedly used.

SUMMARY OF THE INVENTION

The object of the invention is to provide a photosensitive member containing a phthalocyanine as a charge generating material, in particular, of unstable crystal type, being excellent in stability of charging potential and repetition properties.

This invention relates to a photosensitive member having a laminated photosensitive layer constituted of a charge generating layer and a charge transporting layer on an electrically conductive substrate, wherein the charge generating layer comprises a phthalocyanine compound as a charge generating material and an additive selected from the group consisting of indoles having a primary amino group, indazoles having a primary amino group, planar monocyclic compounds of five-membered ring or more having a primary amino group, anthrones represented by the general formula [I] below and acridones represented by the general formula [II] below;

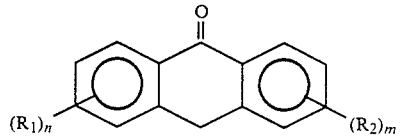

[I]

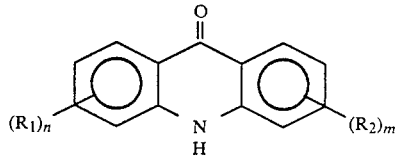

[II]

wherein n and m are an integer of 0–3 respectively; $R_1$ and $R_2$ are independently an alkyl group, an alkoxy group, an amino group, a hydroxy group, a halogen atom or a nitro group; when n is 2 or more, each $R_1$ may be same or different; when m is 2 or more, each $R_2$ may be same or different.

DETAILED DESCRIPTION OF THE INVENTION

This invention relates to a photosensitive member having a laminated photosensitive layer constituted of a charge generating layer and a charge transporting layer on an electrically conductive substrate, wherein the charge generating layer comprises a phthalocyanine compound as a charge generating material and an additive selected from the group consisting of indoles having a primary amino group, indazoles having a primary amino group, indazoles having a primary amino group, planar monocyclic compounds of five-membered ring or more having a primary amino group, anthrones represented by the general formula [I] below and acridones represented by the general formula [II] below;

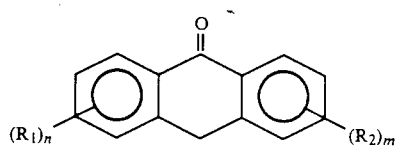

[I]

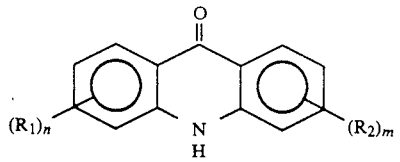

[II]

wherein n and m are an integer of 0–3 respectively; $R_1$ and $R_2$ are independently an alkyl group, an alkoxy group, an amino group, a hydroxy group, a halogen atom or a nitro group; when n is 2 or more, each $R_1$ may be same or different; when m is 2 or more, each $R_2$ may be same or different.

Such additives function to decrease the changes in properties such as charging potential, sensitivity and the like and to improve repetition stability.

It is thought that the additives of the present invention are adsorbed selectively by a phthalocyanine compound to quench the active points of the phthalocyanine, resulting in the prevention of carrier trap etc. and the stabilization of charging potential at repeated use.

With respect to a phthalocyanine compound, the one per or derivatives thereof may be used, more particularly, exemplified by a phthalocyanine compound having a metal at the center such as copper, silver, beryllium, magnesium calcium, gallium, zinc, cadmium, barium, mercury, aluminium, indium, lathanum, neodymium, samarium, europium, gadolinium, dysprosium, holmium, sodium, lithium, ytterbium, butetium, titanium, tin, hafnium, lead, thorium, vanadium, antimony, chromium, molybdenum, uranium, manganese, iron, cobalt, nickel, rhodium, osmium, or platinum. Those metals may be in the form of metal halide with three or more valences.

Derivatives of metal or metal-free phthalocyanine are exemplified by copper-4-aminophthalocyanine, iron-polyhalophthalocyanine, cobalt-hexaphenyl phthalocyanine, vanadyl phthalocyanine, tetra-azo phthalocyanine tetramethylphthalocyanine, dalkylaminophthalocyanine or the like.

Phthalocyanine compounds above mentioned may be used singly or in combination with other phthalocyanine compound.

Indoles having a primary amino group and being one of additives of the present invention which may be contained in a photosensitive layer together with a phthalocyanine compound are exemplified by indole, isoindole, 2-indolinone, 3H-indolenine, 2H-indolenine, indoxyl, isatin, carbazole and the like, each of which has a primary amino group and further may have other substituents.

Indazoles having a primary amino group and being one of additives of the present invention which may be contained in a photosensitive layer together with a phthalocyanine compound are exemplified by indazole, 3-indazolinone and he like, each of which has a primary amino group and further may have other substituents.

Planar monocyclic compound of five-membered ring or more having a primary amino group and being one of additives of the present invention which may be contained in a photosensitive layer together with a phthalocyanine compound are in no way restrictive but excemplified by five-membered compounds such as aminopyrazole, aminoimidazole, aminoxazole, aminoisoxazole, aminothiazole, aminoisothiazole, aminotriazole, aminotetrazole, aminoxadiazole, aminothiodiazole, aminopyrrole, aminopyrrolidone, aminopyrazoline, aminopyrazolone, aminoimidozoline, aminoisoimidazolidone, aminoxazoline, amino-isoxazolidone, aminothiazoline, aminoisothiazoline, and derivatives thereof which have a substituent such as an alkyl group, an alkoxy group, a phenyl group, a halogen atom a nitro group, a cyano group or the like; six-membered ring compounds such as aniline, aminopyridine, aminopyridazine, aminopyrimidine, aminopyrazine, aminotriazine, aminothiazine, aminoxazine, and derivatives thereof which have an alkyl group, an alkoxy group, a phenyl group, a halogen atom, a nitro group, a cyano group or the like.

Further compounds which may be contained in a photosensitive layer together with a phthalocyanine compound as an additive of the present invention are exemplified by anthrones represented by the general formula [I] below and acridones represented by the general formula [II] below;

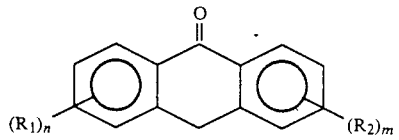

[I]

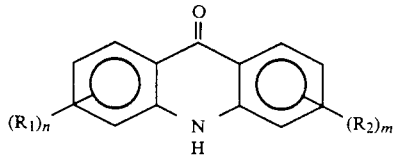

[II]

wherein n and m are an integer of 0–3 respectively; $R_1$ and $R_2$ are independently an alkyl group, an alkoxy group, an amino group, a hydroxy group, a halogen atom or a nitro group; when n is 2 or more, each $R_1$ may be same or different; when m is 2 or more, each $R_2$ may be same or different.

With respect to an amount of an additive contained in a photosensitive layer, the additive is added at the content of 0.01–10 parts by weight, preferably 0.1–1 part by weight on the basis of 1 part by weight of a phthalocyanine compound. If the amount is low so much, the effects of the invention can not be appreciated. If the content is high so much a dispersion stability of an application solution for the formation of a photosensitive layer on an electrically conductive substrate becomes poor and the adhesive properties becomes also poor, and that even if a photosensitive layer is formed at such high content, the obtained photosensitive member has such a problem as the increase of residual potential.

With respect to the structure of a photosensitive member, it may be a monolayer type in which a photosensitive layer is formed on an electrically conductive substrate by dispersing a phthalocyanine compound as a photoconductive material, an additive selected in the present invention, if necessary, a charge transporting material; or preferably a laminated type in which a photosensitive layer is a function divided type and formed by laminating a charge generating layer on an electrically conductive substrate and then laminating a charge transporting layer on the charge generating layer, or in reverse by laminating a charge generating layer on a charge transporting layer on a electrically conductive substrate, a laminated type effects the improvement of sensitivity, charging properties, surface strength and the like required for a photosensitive member.

An electrically conductive substrate is exemplified by a sheet or a drum made of metal or alloy such as copper, aluminum, silver, iron, and nickel; a substrate such as a plastic film on which the foregoing metal or alloy is adhered by a vacuum-deposition method or an electroless plating method and the like; a substrate such as a plastic film and paper on which an electroconductive layer is formed by applying or depositing electroconductive polymer, indium oxide, tin oxide etc..

In general, when a charge generating layer is formed on an electrically conductive substrate, a phthalocyanine compound as a charge generating material is dispersed in a solution containing a binder resin in an appropriate solvent and the dispersion is applied on an electrically conductive substrate, followed by drying.

In order to incorporate an additive selected in the present invention into a charge generating layer, the additive may be added into a dispersed solution above mentioned, adsorbed into phthalocyanine particles prior to dispersion, added at the same time of application of a dispersed sulution, or adsorbed into a charge generating layer after a dispersed solution was applied on an electrically conductive substrate.

Applicable as a binder resin for the production of a photosensitive layer are any of thermoplastic resins, thermosetting resins, photocuring resins and photoconductive resins, which are publicly known to be electrically insulative.

Some examples of binders are shown with no significance in restricting the embodiment of the invention by polyester, polyvinylbutyral, polyvinylacetal, (metha)acrylic resin, polyvinylchloride, copolymer of vinylchloride-vinylacetate, polyvinylidene chloride, alkyd resin, urethane resin, phenol resin, phenoxy resin, a mixture thereof.

Applicable as a charge transporting material for the production of a charge transporting layer are positive-hole-transporting compounds such as anthracene, pyrene, a carbazole derivative, a tetrazole derivative, metallocene, a phenothiazine derivative, pyrazoline, a hydrazone compound, a styryl compound, a styrylhydrazone compound, a thiazole compound, an oxazole compound, an oxadiazole compound, a imidazole compound, a phenylenediamine derivative, a stilbene derivative and a polymer thereof.

Applicable as a binder resin for the production of a charge transporting layer are any of thermoplastic resins, thermosetting resins, photocuring resins and photoconductive resins, which are publicly known to be electrically insulative, being the same as those described on the resins for the formation of a charge generating layer. Some examples are shown with no significance in restricting the embodiment of the invention by polymer or copolymer of (metha)acrylic monomer, acrylonitrile, styrene, butadiene, vinylacetate, vinyl chloride and the like, polycarbonates, polyarylates, polyesters, polysulfones, polyethersulfones, polyamides, epoxy resins, urethane resins, alkyd resins, silicone resins, or a mixture thereof.

This invention is exemplified by Examples.

Examples A1–A6 show photosensitive members wherein indole compounds and/or indazole compounds, each of which have a primary amine group; are used.

Examples B1–B6 show photosensitive members wherein planar monocyclic compounds of five-membered ring or more having a primary amino group.

Examples C1–C4 show photosensitive members wherein anthrone compounds and/or acridone compounds.

EXAMPLE A1

One part by weight of o-type titanyl phthalocyanine as a charge generating material, one part by weight of polyvinylbutyral (S-Lec BL-S) and 98 parts by weight of cyclohexanone were mixed for dispersion in a paint conditioner for 3 hours.

Then, 6-aminoindazole of 0.1 part by weight was added to the above-obtained dispersed solution to prepare an application solution for a charge generating layer.

A cylindrical aluminium drum was dipped in the application solution so that a charge generating layer of 0.2 μm in thickness might be formed thereon after dried.

Then, 10 parts by weight of the butadiene compound as a charge transporting material represented by the formula [I] below;

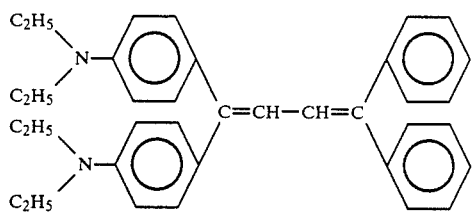

[I]

were dissolved in a solution of polycarbonate (10 parts by weight) (K-1300; made by Teijin Kasei K.K.) in dichloromethane of 90 parts by weight to prepare an application solution for a charge transporting layer.

A charge generating layer formed on the cylindrical aluminium drum was dipped in the application solution above obtained so that a charge transporting layer of 20 μm in thickness might be formed on the charge generating layer after dried. Thus, a photosensitive member with two layers as a photosensitive layer was prepared.

In a manner similar to Example A1, photosensitive members were prepared except that charge generating layers were prepared using materials shown in Table 1, including Comparative Examples.

TABLE 1

| | Charge generating layer | | | | |
|---|---|---|---|---|---|
| Example | charge generating material (CGM) | parts by weight (CGM) | binder resin | additive | parts by weight of additive |
| A1 | α-type titanyl phthalocyanine | 1 | polyvinyl butyral | 6-amino-indazole | 0.1 |
| A2 | ↑ | ↑ | ↑ | 5-amino- | ↑ |

TABLE 1-continued

| Example | Charge generating layer: charge generating material (CGM) | parts by weight (CGM) | binder resin | additive | parts by weight of additive |
|---|---|---|---|---|---|
| A3 | ↑ | ↑ | ↑ | indole N-amino-carbazole | ↑ |
| A4 | ↑ | ↑ | ↑ | ↑ | 0.5 |
| A5 | ↑ | ↑ | ↑ | ↑ | 1 |
| A6 | ε-type copper phthalocyanine | ↑ | ↑ | 6-amino imidazole | 0.1 |
| B1 | α-type titanyl phthalocyanine | ↑ | ↑ | 3-amino-pyridine | ↑ |
| B2 | ↑ | ↑ | ↑ | ↑ | 0.3 |
| B3 | ↑ | ↑ | ↑ | ↑ | 0.9 |
| B4 | ↑ | ↑ | ↑ | ↑ | 3 |
| B5 | ↑ | ↑ | ↑ | p-toluidine | 0.1 |
| B6 | ↑ | ↑ | ↑ | melamine (2,4, 6-triamino-1, 3-5-triazine | 0.1 |
| B7 | ↑ | ↑ | ↑ | 3-amino-pyrazole | ↑ |
| B8 | ε-type copper phthalocyanine | ↑ | ↑ | 3-amino pyridine | ↑ |
| C1 | α-type titanyl phthalocyanine | ↑ | ↑ | anthrone | 0.3 |
| C2 | ↑ | ↑ | ↑ | ↑ | 1 |
| C3 | ↑ | ↑ | ↑ | acridone | 0.3 |
| C4 | α-type copper phthalocyanine | ↑ | ↑ | anthrone | 0.3 |
| A1 | α-type titanyl phthalocyanine | 1 | polyvinyl butyral | none | — |
| A2 | ↑ | ↑ | ↑ | carbazole | 0.1 |
| A3 | ↑ | ↑ | ↑ | 1-amino-naphthalene | ↑ |
| A4 | ↑ | ↑ | ↑ | 2-amino-anthracene | ↑ |
| A5 | ε-type copper phthalocyanine | ↑ | ↑ | none | — |
| B1 | α-type titanyl phthalocyanine | ↑ | ↑ | 1,3,5-tri-azine | 0.1 |
| B2 | ↑ | ↑ | ↑ | pyrazole | ↑ |
| C1 | ↑ | ↑ | ↑ | anthraqinone | 0.3 |
| C2 | ↑ | ↑ | ↑ | anthracene | 0.3 |
| C3 | ↑ | ↑ | ↑ | none | — |

Initial surface potential $V_0$[V] and exposure amount for half-reduction $E_{\frac{1}{2}}$ (erg/cm$^2$)(which is the exposure amount required for the surface potential to be half the value of the initial surface potential) were measured on the above obtained photosensitive members.

After 3000 times repetitions of charging and charge-removing process, $V_0$ and $E_{\frac{1}{2}}$ were also measured to evaluate repetition stability.

By the way, the measurements were made with a converted laser beam printer (SP-348; made by Nissho Electronics K.K.) available in the market.

A photosensitive member was installed in the converted laser printer to measure $V_0$ and $E_{\frac{1}{2}}$, in which grid potential of scorotoron charger was adjusted so that a photosensitive member might be charged at about −700V.

The results were shown in Table 2 below.

TABLE 2

| | initial properties | | after 3000 times | |
|---|---|---|---|---|
| | $V_0$ (V) | $E_{\frac{1}{2}}$ erg/cm$^2$ | $V_0$ (V) | $E_{\frac{1}{2}}$ erg/cm$^2$ |
| Example A1 | −705 | 3.5 | −715 | 3.6 |
| Example A2 | −700 | 3.4 | −720 | 3.7 |
| Example A3 | −710 | 3.4 | −690 | 3.6 |
| Example A4 | −700 | 3.2 | −720 | 3.3 |
| Example A5 | −695 | 3.0 | −735 | 3.4 |
| Example A6 | −705 | 17.0 | −695 | 16.0 |
| Example B1 | −700 | 3.3 | −730 | 3.5 |
| Example B2 | −705 | 3.1 | −725 | 3.3 |
| Example B3 | −700 | 2.9 | −730 | 3.2 |

TABLE 2-continued

| | initial properties | | after 3000 times | |
|---|---|---|---|---|
| | $V_0$ (V) | $E_{\frac{1}{2}}$ erg/cm$^2$ | $V_0$ (V) | $E_{\frac{1}{2}}$ erg/cm$^2$ |
| Example B4 | −710 | 3.5 | −740 | 3.7 |
| Example B5 | −695 | 3.8 | −680 | 3.9 |
| Example B6 | −700 | 3.3 | −690 | 3.3 |
| Example B7 | −710 | 3.5 | −715 | 3.7 |
| Example B8 | −705 | 16.0 | −725 | 17.5 |
| Example C1 | −700 | 4.2 | −760 | 5.6 |
| Example C2 | −705 | 4.7 | −780 | 6.0 |
| Example C3 | −705 | 3.5 | −725 | 3.8 |
| Example C4 | −710 | 9.8 | −720 | 10.5 |
| Comparative Example | | | | |
| A1 | −710 | 3.3 | −500 | 2.6 |
| A2 | −705 | 3.5 | −525 | 2.8 |
| A3 | −700 | 3.6 | −570 | 3.1 |
| A4 | −700 | 3.9 | −540 | 3.2 |
| A5 | −705 | 16.5 | −480 | 11.0 |
| B1 | −710 | 3.4 | −550 | 2.8 |
| B2 | −700 | 3.3 | −540 | 2.7 |
| C1 | −700 | 3.3 | −520 | 2.7 |
| C2 | −705 | 3.4 | −530 | 2.8 |
| C3 | −710 | 9.5 | −570 | 7.2 |

As understood from the results shown in Table 2, photosensitive members of the present invention excellent in repetition stability because $V_0$ and $E_{\frac{1}{2}}$ varied little even after 3000 times repetitions.

What is claimed is:

1. A photosensitive member having a laminated photosensitive layer constituted of a charge generating layer and a charge transporting layer on a electrically conductive substrate, wherein the charge generating layer comprises an unstable crystal type of a phthalocyanine compound as a charge generating material and an additive selected from the group consisting of indoles having a primary amino group, indazoles having a primary amino group, planar monocyclic compounds of five or six-membered heterocyclic rings with nitrogen or nitrogen plus oxygen or sulfur having a primary amino group, anthrones represented by the general formula [I] below and acridones represented by the general formula [II] below;

[I]

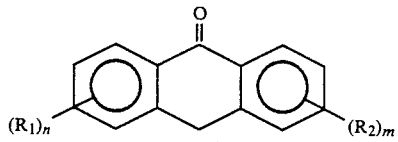

[II]

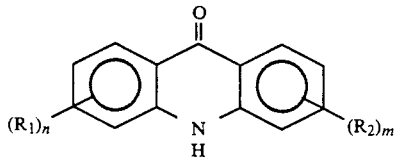

wherein n and m are an integer of 0–3 respectively; $R_1$ and $R_2$ are independently an alkyl group, an alkoxy group, an amino group, a hydroxy group, a halogen atom or a nitro group; when n is 2 or more, each $R_1$ may be the same or different; when m is 2 or more, each $R_2$ may be the same or different; wherein said additive is contained at the content of 0.01–10 parts by weight on the basis of one part by weight of the phthalocyanine compound.

2. A photosensitive member of claim 1, wherein, the phthalocyanine compound is o-type, titanyl phthalocyanine.

3. A photosensitive member of claim 1, wherein the indoles are aminoindole, aminoisoindole, amino-2-indolinone, amino-3H-indolenine, amino-2H-indolenine, aminoindoxyl, aminoisatin or aminocarbazole.

4. A photosensitive member of claim 1, wherein the indazoles are aminoindazole or amino-3-indazolinone.

5. A photosensitive member of claim 1, wherein the planar monocyclic compounds of five-membered ring are aminopyrazole, aminoimidazole, aminoxazole, aminoisoxazole, aminothiazole, aminoisothiazole, aminotriazole, aminotetrazole, aminoxadiazole, aminothiodiazole, aminopyrrole, aminopyrrolidone, aminopyrazoline, aminopyrazolone, amino-imidozoline, aminoisoimidazolidone, aminoxazoline, aminoisoxazoline, aminoxazolone, aminoxisoxazolidone, aminothiazoline or aminoisothiazoline and derivatives thereof.

6. A photosensitive member of claim 1, wherein the planar monocyclic compounds of six-membered ring are aniline, aminopyridine, aminopyridazine, aminopyrimidine, aminopyrazine, aminotriazine, aminothiazine, aminoxazine or and derivatives thereof.

7. A photosensitive member of claim 1, wherein the charge generating layer is formed on the charge transporting layer.

8. A photosensitive member of claim 1, wherein the charge transporting layer is formed on the charge generating layer.

9. A photosensitive member having a photosensitive layer with a charge generating material dispersed in a resin on an electrically conductive substrate, wherein the photosensitive layer comprises an unstable crystal type of a phthalocyanine compound as a charge generating material and an additive selected from the group consisting of indoles having a primary amino group, indazoles having a primary amino group, planar monocyclic compounds of five or six-membered heterocyclic rings with nitrogen or nitrogen plus oxygen or sulfer having a primary amino group, anthrones represented by the general formula [I] below and acridones represented by the general formula [II] below;

[I]

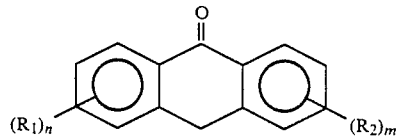

[II]

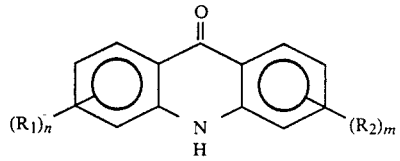

wherein n and m are an integer of 0–3 respectively; $R_1$ and $R_2$ are independently an alkyl group, an alkoxy group, an amino group, a hydroxy group, a halogen atom or a nitro group; when n is 2 or more, each $R_1$ may be the same or different; when m is 2 or more, each $R_2$ may be the same or different; wherein said additive is contained at the content of 0.01–10 parts by weight on the basis of one part by weight of the phthalocyanine compound.

10. A photosensitive member of claim 9, wherein the photosensitive layer further comprises a charge transporting material.

* * * * *